US011305918B2

(12) United States Patent
Schefler

(10) Patent No.: US 11,305,918 B2
(45) Date of Patent: Apr. 19, 2022

(54) BOTTLE WITH CLOSURE MEANS

(71) Applicant: SPI Group S.à.r.l, Luxembourg (LU)

(72) Inventor: Yuri Schefler, Crans-Montana (CH)

(73) Assignee: SPI Group S.à.r.l, Luxembourg (LU)

( * ) Notice: Subject to any disclaimer, the term of this patent is extended or adjusted under 35 U.S.C. 154(b) by 151 days.

(21) Appl. No.: 16/607,935

(22) PCT Filed: Apr. 24, 2018

(86) PCT No.: PCT/EP2018/060508
§ 371 (c)(1),
(2) Date: Oct. 24, 2019

(87) PCT Pub. No.: WO2018/197518
PCT Pub. Date: Nov. 1, 2018

(65) Prior Publication Data

US 2020/0339307 A1 Oct. 29, 2020

(30) Foreign Application Priority Data

Apr. 24, 2017 (NL) ..... 2018773

(51) Int. Cl.
*B65D 39/16* (2006.01)
*B65D 45/24* (2006.01)
(Continued)

(52) U.S. Cl.
CPC ..... *B65D 39/16* (2013.01); *B65D 45/24* (2013.01); *B65D 39/0058* (2013.01);
(Continued)

(58) Field of Classification Search
CPC .... B65D 45/00–24; B65D 39/00–0058; B65D 45/34; B65D 43/267; B65D 1/0253;
(Continued)

(56) References Cited

U.S. PATENT DOCUMENTS 1,348,808 A 8/1920 Kivlan
4,735,338 A * 4/1988 Stancil ..... B65D 45/16 215/290
(Continued)

FOREIGN PATENT DOCUMENTS

CH 50941 A 7/1911
CH 243573 A 7/1946
(Continued)

OTHER PUBLICATIONS

Chinese Office Action for Application No. 201880041089.2, dated Oct. 9, 2020.
(Continued)

*Primary Examiner* — Kareen K Thomas
(74) *Attorney, Agent, or Firm* — Hoffmann & Baron, LLP

(57) ABSTRACT

A bottle includes a neck and an opening at an end of said neck. A closure member closing the opening is provided with locking means that secure the closure member to a rim of the opening. The locking means include a collar surrounding a neck portion of the neck and locking-levers that are hingedly connected to the collar. The closure member includes outwardly extending lugs that register with the locking-levers. The locking-levers include link members that releasable engage the lugs at a top surface thereof. The locking-levers are retractable to a closed position in which the link members clamp the closure member to the rim of the opening.

15 Claims, 2 Drawing Sheets

(51) Int. Cl.
*B65D 39/00* (2006.01)
*B65D 45/06* (2006.01)

(52) U.S. Cl.
CPC ..... *B65D 45/06* (2013.01); *B65D 2539/003* (2013.01); *B65D 2539/008* (2013.01)

(58) Field of Classification Search
CPC .... B65D 23/0857; B65D 5/247; B65D 5/103; B65D 5/10; B65D 2255/02; B65D 2255/00; B65D 55/02; B65D 2539/00–008
See application file for complete search history.

(56) References Cited

U.S. PATENT DOCUMENTS 4,915,913 A * 4/1990 Williams ..... A61L 2/26 220/324
5,127,684 A * 7/1992 Klotz ..... E05C 19/14 292/113
5,385,259 A * 1/1995 Bernstein ..... B65F 1/06 220/212.5
5,520,303 A * 5/1996 Bernstein ..... B65F 1/06 220/495.08
5,735,428 A * 4/1998 Chern ..... B65D 45/24 190/120
6,789,692 B2 * 9/2004 Prezelin ..... B65D 45/20 190/119
7,854,344 B2 * 12/2010 Suk ..... B65D 43/0212 220/326
2014/0231442 A1 8/2014 Hill et al.
2014/0262899 A1 9/2014 Mociak

FOREIGN PATENT DOCUMENTS

CH 272732 A 12/1950
CN 204776588 U 11/2015
DE 249967 C 9/1911
DE 1721585 U 5/1956
FR 331473 A 9/1903
FR 412480 A 7/1910
FR 658075 A 5/1929
FR 759913 A 2/1934
FR 1392611 A 3/1965
JP S56-28954 U 3/1981
JP H2-131948 U 11/1990
JP 3145385 U 10/2008

OTHER PUBLICATIONS

Japanese Office Action for counterpart foreign application, dated Nov. 25, 2020, 12 pages.

* cited by examiner

BOTTLE WITH CLOSURE MEANS

CROSS-REFERENCE TO RELATED APPLICATIONS

This application is the National Stage of International Application No. PCT/EP2018/060508, filed Apr. 24, 2018, which claims the benefit of Netherlands Application No. 2018773, filed Apr. 24, 2017, the contents of which is incorporated by reference herein.

FIELD OF THE INVENTION

The present invention relates to a bottle and closure means, said bottle comprising a neck, an opening at an end of said neck, a closure member closing said opening and locking means that secure said closure member to a rim of said opening, in which said locking means comprise a collar surrounding a neck portion of said neck and locking levers that are hingedly connected to said collar, and wherein said bottle contains a non gaseous liquid.

BACKGROUND OF THE INVENTION

A bottle is known from Chinese Utility model nr. 204 776 588. This known bottle with closure means comprise a collar surrounding a neck portion of the bottle together with a pair of link members that are hingedly connected to said collar. An opening of the bottle is closed by means of a cap that has a corresponding pair of lugs extending downwards and comprising a hook at their free distal end. Said link members engage said hooks at a back surface of the lugs. The bottle may be tightly closed by pressing down the levers that are coupled to the link members to lower the link members together with the lugs that they engage. This will clamp the cap onto the bottle to close and seal the opening. Raising the levers will release the clamping force of the cap to the bottle such that the cap may be lifted from the opening.

A disadvantage of the known bottle and closure mechanism is that both while opening and closing the bottle, the linking members and the lugs of the cap are in a mutually engaged and entangled relationship which hinders the manipulation of the closure. Moreover the known closure means merely serve to close the bottle, while releasing the cap from the bottle is carried out substantially unassisted. Further the known closure member provides hardly any means for giving the bottle a more luxurious, appealing appearance as is commercially important for many high-end alcoholic liquors.

SUMMARY OF THE INVENTION

It is inter alia an object of the present invention to provide a bottle with closure means that solve one or more of these drawbacks of the known bottle and closure at least to a substantial degree.

In order to meet this aim of the invention, a bottle of the type as described in the opening paragraph, according to the invention, is characterized in that said closure member comprises a solid core and outwardly extending lugs that register with said locking levers, and in that said locking levers comprise link members that releasable engage said lugs at a top surface thereof, said locking levers being retractable to a closed position in which said link members clamp said closure member to the rim of said opening. Contrary to the known closure means, these closure means engage on a top surface of the lugs that extend outwardly.

Once released from this engaging position the linking members are separated from the lugs and, hence, will not hinder the further manipulation of the closure member. And also on closing the bottle, the closure member may be placed in the opening first, before the linking members engage, so that also in this situation both members will not interfere with one another. This results in a very convenient but no less secure manner of opening and closing the bottle, while the closure member provides a platform to give the bottle a more exclusive appearance.

In a closed state a clamping force will be exerted between the collar and the closure member, said force being transmitted by the linking members. In order to secure the collar on the neck portion in this situation, a particular embodiment of the bottle according to the invention is characterized in that said neck comprises a ridge adjacent said neck portion and in that said collar engages said ridge in the closed position. The ridge will exert a counter force on the collar, once said collar engages said ridge. This will hold the collar onto the neck portion of the bottle.

In order to provide additional free length to the link members and, hence, additional freedom of movement of the locking levers, a preferred embodiment of the bottle according to the invention is characterized in that said ridge is a shoulder of a thickened further neck portion that comprises said rim of said opening and in that said link members bridge said thickened neck portion between said collar and said lugs.

The outwardly extending lugs are being engaged at their top surface by the link members. For a proper and equal positioning of the link members on this primarily horizontal face of the lugs, a preferred embodiment of the bottle according to the invention is characterized in that said lugs are provided with seats that receive a free distal end of said link members of said locking levers. Due to the presence of these seats, the link members may easily be provided at the correct location by nesting them within these seats in which they will be trapped. As the location of the seats is set in the device, this ensures an even distribution of clamping forces at opposite sides of the closure member once the locking levers are retracted. In a practical embodiment the bottle according to the invention is characterized in that said seats comprise local depressions that are formed in said lugs and/or said lugs extend at an inclination away from the locking-levers.

A further particular embodiment of the bottle according to the invention is characterized in that said link members comprise a loops extending from said collar to a free distal end thereof. These loops provide an easy to use solution for the link members which in that case will engage the lugs of the closure members with the free end of the loops by simply putting the loops around the lugs and retracting the locking levers.

A especially preferred embodiment of the bottle according to the invention is characterized in that said link members comprise an eye at a free distal end thereof that catches and surrounds said lug. In this situation the link members not only engage but also catch the lugs. As a consequence the closure member will not only be drawn into or onto the opening when the locking levers are retracted, but the closure member will also be lifted from or out of the opening to a certain extent once the levers are released. On releasing the levers the link members will exert an upwardly directed force to the lugs that is being transmitted by a rim of the eye that catches the lug. A particular embodiment of the bottle according to the invention, in which the link members are loops, is characterized in this respect in that said loop comprises a constriction of smaller dimension than said lug to form said eye at said free distal end to catch and surround said lug.

A bottle of the kind as described in this application will usually be used to contain a fluid, particularly a spirit or other (alcoholic) drink. In order to securely seal the bottle in a leak proof manner, a further special embodiment of the bottle according to the invention is characterized in that said closure member comprises a resilient bottom portion that extends fittingly into said opening, and more particularly in that said resilient portion of said closure member comprises an elastomer or cork. The resilient nature of the bottom portion of the closure member will ensure that the closure member will adapt to the exact shape and dimension of the rim of the opening once it is being clamped to the rim. The use of cork will still allow the product to still breath and will give the closure member a nice and attractive appearance concurring with luxurious spirits and liquors like cognac, brandy, whisk(e)y, vodka and tequila.

In this latter respect a further particular embodiment of the bottle according to the invention is characterized in that, at least substantially, said locking means are made of metal, particularly having at least an appearance of a noble metal. Apart from being strong and durable, the luxurious nature of the product contained in the bottle is thereby enhanced by the use of noble metal for the closure mechanism or the use of metal plated by a noble metal or coated with a noble metal looking coating. This is further emphasized in a further particular embodiment of the bottle according to the invention that is characterized in that said closure member carries an adornment at a side across from the opening. Particularly, such an adornment may comprise a decoration or other kind of attractive and exclusive appearance that highlights the quality and exclusivity of the product inside the bottle.

BRIEF DESCRIPTION OF THE DRAWINGS

The invention will now be described in further detail with reference to a specific embodiment and accompanying drawings. In the drawings.

DETAILED DESCRIPTION OF THE INVENTION

Figure 1:
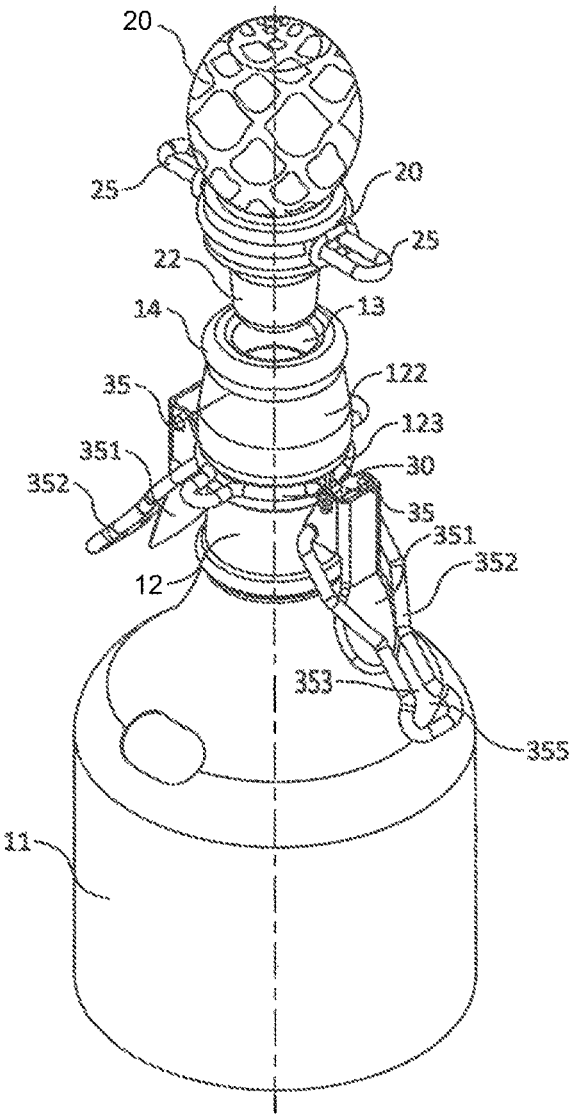
FIG. 1 shows a specific embodiment of a bottle according to the invention.

It is noted that the figures are drawn schematically and not always to the same scale. Particularly, certain dimensions may be exaggerated to a larger or smaller extend for the purpose of clarity. Similar parts will be indicated by the same reference numerals throughout the drawing.

FIG. 1 shows an embodiment of a bottle and closure mechanism according to the invention in a open stage. The bottle 10 can be made of glass, ceramics or any other kind of durable water tight material. In this example a glass bottle with typically a contents of between 500 and 1000 ml is used with an aesthetic texture generally referred to as opaline glass or white glass. Such a bottle may for instance be used for luxurious spirits and liquors like cognac, brandy, whisk (e)y, vodka and tequila. The bottle 10 comprises a belly 11 together with a neck 12 and is accessible through an opening 13 at the end of the neck that is surrounded by a rim 14. The neck 12 comprises a lower neck portion 121 adjacent an upper portion 122 that is somewhat thicker between a shoulder 123 and the rim 14.

Figure 2A:
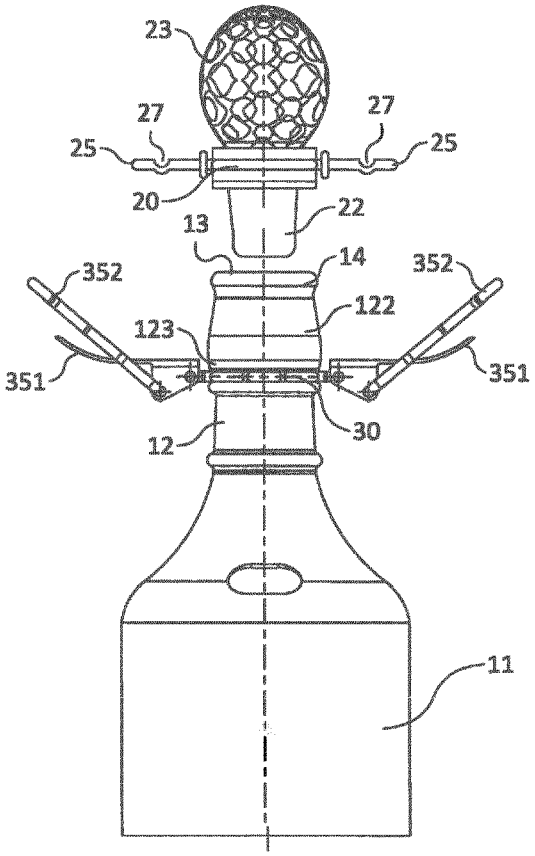
FIGS. 2A-D show the bottle of FIG. 1 in consecutive stages of operation.
Figure 2B:
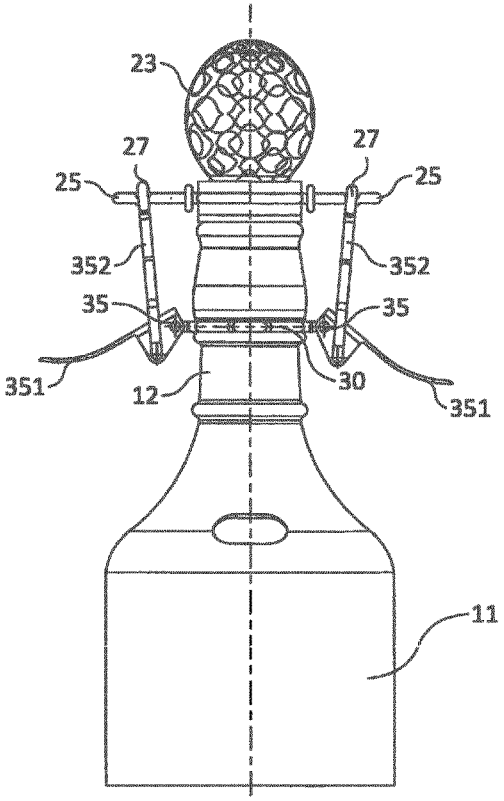
Figure 2C:
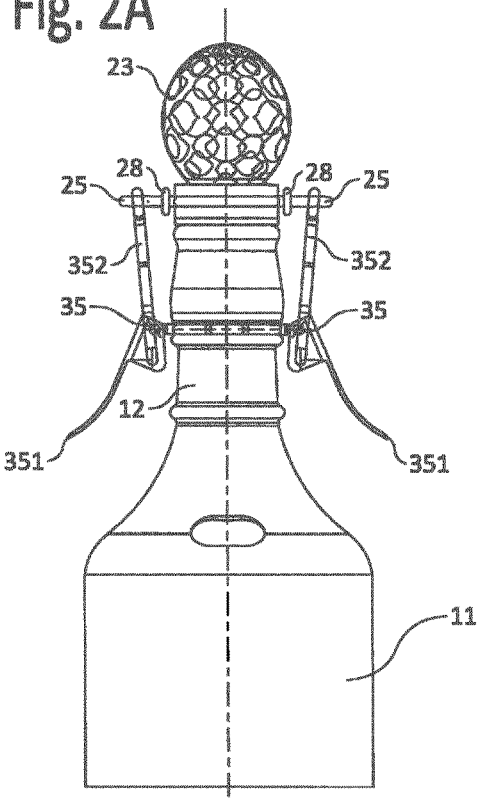
Figure 2D:
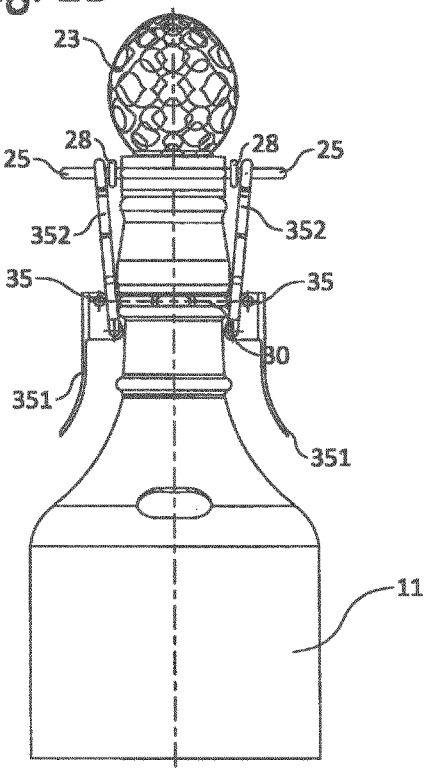

In order to be able to securely close the bottle, said bottle is provided with closure means. Said closure means comprise a closing member 20 in the form of a cap or stopper that fits into the opening 13. A bottom portion 22 of the cap 20 is formed of a resilient material like rubber or any other elastomer compound or, like in this case, cork. The resilient nature of this bottom portion 22 ensures a close fit in the opening 13 in order to properly seal the bottle 10. At the front face said cap may carry an adornment or other attractive decoration to give the bottle and product contained therein a more luxurious appearance. According to the invention this closure member 20 is provided with radially outwardly extending lugs 25. These lugs extend on opposite sides of the cap 20 and each comprise a seat 27 at substantially a same distance from a centre of the cap 20. In the case of FIGS. 2A and 2B, the seats 27 comprise local depressions that are formed in said lugs 25. Alternatively the lugs 25 may be given a slight upward inclination and seats 28 may be formed adjacent the cap. This is depicted in FIGS. 2C and 2D.

The closing means further comprises locking means that are intended and capable of securing the closure member 20 to the opening 13. These locking means comprise a collar 30 that sits around the neck portion 121 adjacent the upper portion 122 of the neck 12. Said collar 30 thereby rests against a ridge that is formed by the shoulder 123 of said upper portion 122. At opposite sides locking levers 35 are hingedly connected to said collar 30. Both the collar 30 and locking levers are formed of metal in the present embodiment, more particularly of gold plated or gold paint coated metal. Metal not only provides strength and durability but moreover adds to the image and appearance of the bottle, especially if made of or looking like a noble metal like gold.

The locking levers 35 each comprise a lever 351 together with a link member 352. The link members 352 comprise latches or clasps and are pivotally connected to the levers 351 at a certain distance from a pivot point of the levers 351 with respect to the collar. As a consequence, on pulling down the levers 352 the latches 352 will be retracted by this action. As shown in FIG. 1, the latches 352 comprise a wire loops that hinge around the levers 352 and that have a constriction 353 near a distal end to for an eye 355 at said distal end. Said constriction 353 is made to a smaller dimension than the width of the lugs 25 at the area of the seats 27 as will be explained in further detail below.

In order to close the bottle 10, the closure member 20 is placed in top of the opening, see FIG. 2A. Next the latches 352 are swung out and placed over the lugs 25, see FIGS. 2A 2D, until the distal ends of the latches engage the top surface of the lugs 25 and are seated at the location of the depression 27, see FIG. 2B. In this situation, the lugs 25 are caught and captured within the eye portion 355 of the latches 352. Alternatively, see FIG. 2C, the latches 352 will slide down to be seated against the seats 28, see FIG. 2D, due to the slight inclination of the lugs 25. Both alternatives ensure that the eventual position of the lugs with respect of the centre of the cap will be the same at both sides of the cap.

In order to secure the closure member 20 to the bottle, next the levers 351 are pulled down, taking with them the latches 352, until they reach there final position, see FIG. 2D. This will exert a downwardly directed force on the lugs 25 that is being transmitted by the latches 352 and that presses the closure 20 firmly down to inside the opening 13 and against the rim 14 to seal the bottle 10.

The previous steps may be performed in reverse order to unlock and open up the bottle. Because the eye portion 355 of the latches 352 will in that case engage the lugs 25 which they surround, these lugs 25, and hence the closure 20, will be lifted in that case to a certain degree as the latches are increasingly released and eventually leave the lugs 25. This substantially eases the opening up of the bottle 10, especially if the cork bottom portion 22 of the closure 20 is sunk relatively deeply inside the opening 13.

Although the invention has been described in greater detail with reference to merely a single embodiment, it will be appreciated that the invention is by no means limited to the embodiment given. On the contrary many variations and embodiments are conceivable for a skilled person without departing from the scope and spirit of the invention and without requiring him to exercise any inventive skill.

The invention claimed is:

1. A bottle and closure means, said bottle comprising a neck, an opening at an end of said neck, a closure member closing said opening and locking means that secure said closure member to a rim of said opening, in which said locking means comprise a collar surrounding a neck portion of said neck and a pair of locking levers that are hingedly connected to said collar, and wherein said bottle contains a non-gaseous liquid, wherein said closure member comprises a solid core and a pair of elongate, outwardly extending lugs that extend beyond opposite sides of the closure member and register with said locking levers, and wherein each of said pair of locking levers comprises a link member pivotably connected to said collar and that releasably engage said lugs at a top surface thereof, said pair of locking levers being retractable to a closed position in which said link members clamp said closure member to the rim of said opening.

2. The bottle according to claim 1, wherein said neck comprises a ridge adjacent said neck portion and in that said collar engages said ridge in the closed position.

3. The bottle according to claim 2, wherein said ridge is a shoulder of a thickened further neck portion that comprises said rim of said opening and in that said link members bridge said thickened neck portion between said collar and said lugs.

4. The bottle according to claim 1, wherein said lugs are provided with seats that receive a free distal end of said link members of said pair of locking levers.

5. The bottle according to claim 4, wherein said seats comprise local depressions that are formed in said lugs and/or said lugs extend with an inclination away from the pair of locking-levers.

6. The bottle according to claim 1, wherein said link members comprise a loop extending from said collar to a free distal end thereof.

7. The bottle according to claim 6, wherein said link members comprise an eye at the free distal end thereof that catches and surrounds said lug.

8. The bottle according to claim 7, wherein said loop comprises a constriction of smaller dimension than said lug to form said eye at said free distal end to catch and surround said lug.

9. The bottle according to claim 1, wherein said closure member comprises a resilient bottom portion that extends fittingly into said opening.

10. The bottle according to claim 9, wherein said resilient portion of said closure member comprises an elastomer or cork.

11. The bottle according to claim 1, wherein, at least substantially, said locking means are made of metal, particularly having at least an appearance of a noble metal.

12. The bottle according to claim 1, wherein said closure member carries an adornment at a side across from the opening.

13. A bottle and closure means, said bottle comprising a neck, an opening at an end of said neck, a closure member closing said opening and locking means that secure said closure member to a rim of said opening, in which said locking means comprise a collar surrounding a neck portion of said neck and a pair of locking levers that are hingedly connected to said collar, and wherein said bottle contains a non-gaseous liquid, wherein said closure member comprises a solid core and a pair of elongate, outwardly extending lugs that extend beyond opposite sides of the closure member and register with said locking levers, wherein each of said pair of locking levers comprises a link member pivotably connected to said collar and that releasably engage said lugs at a top surface thereof, said pair of locking levers being retractable to a closed position in which said link members clamp said closure member to the rim of said opening, wherein said link members comprise a loop extending from said collar to a free distal end thereof, wherein said link members comprise an eye at the free distal end thereof that catches and surrounds said lug, and wherein said loop comprises a constriction of smaller dimension than said lug to form said eye at said free distal end to catch and surround said lug.

14. A bottle and closure means, said bottle comprising a neck, an opening at an end of said neck, a closure member closing said opening and locking means that secure said closure member to a rim of said opening, in which said locking means comprise a collar surrounding a neck portion of said neck and a pair of locking levers that are hingedly connected to said collar, and wherein said bottle contains a non-gaseous liquid, wherein said closure member comprises a solid core and a pair of elongate, outwardly extending lugs that extend beyond opposite sides of the closure member and register with said locking levers, wherein each of said pair of locking levers comprises a link member pivotably connected to said collar and that releasably engage said lugs at a top surface thereof, said pair of locking levers being retractable to a closed position in which said link members clamp said closure member to the rim of said opening, wherein said link members comprise a loop extending from said collar to a free distal end thereof, wherein said link members comprise an eye at the free distal end thereof that catches and surrounds said lug in the closed position, wherein said loop comprises a constriction of smaller dimension than said lug to form said eye at said free distal end to catch and surround said lug;

wherein said pair of locking levers being extendible towards an open position in which the constriction of each loop engages the lugs to lift the closure member away from the opening of the bottle.

15. The bottle and closure means of claim 14, wherein in the open position each loop is disengaged from the lugs, thereby being free therefrom.

* * * * *